United States Patent [19]

Rouchard

[11] 4,149,710

[45] Apr. 17, 1979

[54] WATERSLIDE AMUSEMENT DEVICE

[76] Inventor: Paul P. Rouchard, 1949 Hawthorne Rd., Wilmington, N.C. 28401

[21] Appl. No.: 835,201

[22] Filed: Sep. 21, 1977

[51] Int. Cl.[2] ..... A63G 21/18

[52] U.S. Cl. ..... 272/56.5 R; 405/121; 104/70; 248/49; 285/61

[58] Field of Search ..... 272/56.5 R, 56.5 SS; 104/59, 68, 69, 70, 72, 73, 86, 134, 136; 193/2 R, 14, 38; 61/2, 7, 14, 15; 248/49; 285/61, 64, 405, 412; 182/48, 51, 52

[56] References Cited

U.S. PATENT DOCUMENTS

| | | | |
|---|---|---|---|
| 419,860 | 1/1890 | Libbey | 104/73 |
| 605,474 | 6/1898 | Davidson | 14/14 X |
| 1,124,629 | 10/1915 | Lilienfeld | 104/69 |
| 1,648,196 | 11/1927 | Rohmer | 104/70 |
| 1,745,241 | 1/1930 | Bartlett | 104/68 |
| 2,025,789 | 12/1935 | Templin et al. | 61/15 X |
| 3,343,793 | 9/1967 | Waser | 104/134 X |
| 3,508,405 | 4/1970 | Koch | 272/56.5 R UX |
| 3,923,301 | 12/1975 | Myers | 272/56.5 R |

FOREIGN PATENT DOCUMENTS

| | | | |
|---|---|---|---|
| 337805 | 11/1930 | United Kingdom | 104/73 |

*Primary Examiner*—Richard J. Johnson
*Assistant Examiner*—Arnold W. Kramer
*Attorney, Agent, or Firm*—Lane, Aitken & Ziems

[57] ABSTRACT

A waterslide amusement device includes an inclined slide course fabricated from a plurality of straight and curved flume modules connected together in an end to end relationship. The modules, which are preferably molded as a unitary structure from a fiberglass reinforced resin, have a flange formed at each end which extends outwardly from the sides of the module in a plane transverse to the module with spaced openings through each flange. A plurality of support plates associated with each pair of adjacent flanges have a plurality of openings therein adapted to align with a portion of the aligned openings of respective flanges of adjacent modules whereby the support plates are fastened to support trestles. The modules are connected together by securing the flanges of two adjacent modules together with suitable securing means extending through aligned openings through the flanges and to the support plates. A flow of water is provided between an entry pool at one end of the course and an exit pool at the other end of the course. A waterslide user slides down the course on a flexible mat with the water serving as a lubricant. A splash-down module connected between the course and exit pool has first and second concave paths which diverge from one another toward the exit pool.

18 Claims, 9 Drawing Figures

WATERSLIDE AMUSEMENT DEVICE

BACKGROUND OF THE INVENTION

The present invention relates to waterslide amusement devices, and, more particularly, to waterslides having an inclined water conveying slide course with an entry pool at one end and an exit pool at the other end.

Waterslides generally include an inclined water conveying course having an entry pool at an upper end and an exit pool at a lower end with a flow of water between the entry and the exit pools. A wateslide user slides down the course on a conveyance means, such as a flexible plastic mat, with the water acting as a lubricant. Generally, the slide course is arranged along a sinuous or serpentine path which enhances the amusement value of the slide.

One waterslide device in use is disclosed in U.S. Pat. No. 3,923,301 to Myers. This waterslide provides a slide course formed as a unitary structure from concrete. The course is embedded in the downward sloping portion of a hill and generally follows the terrain of the hill. An entry pool is provided at the upper end of the course and an exit pool is provided at the lower end of the course with a flow of water between the entry and exit pools.

Waterslides utilizing the aforementioned embedded concrete structure suffer from a number of drawbacks which limit their application. Since the slide course must be embedded in a ground formation having a downward slope, substantial earth moving operations may be required to either alter an existing formation or construct an entirely manmade formation to receive the waterslide. Additionally, skilled concrete workers, including casting form erectors, reinforcing bar installers, and finishers are needed to construct the waterslide. When the slide course is completed, its interior surface must be periodically coated with a material or compound which waterproofs the course and provides a smooth surface to prevent abrasion injuries to the waterslide users and to minimize friction between the conveying mat and the slide surfaces. As with any concrete structure, the slide course is subject to cracking as a result of soil shifting or subsidence. As can be readily appreciated, embedded concrete slides can be both expensive to construct and maintain.

SUMMARY OF THE INVENTION

It is therefore an object of the present invention to provide a waterslide amusement device which may be supported above the ground to minimize the effect of ground surface terrain on the path of the slide course.

It is another object of the present invention to provide a waterslide amusement device which may be fabricated from a plurality of flume modules which may be quickly connected together in an end to end relationship by relatively unskilled labor.

It is still another object of the present invention to provide a waterslide amusement device having an inherently smooth and waterproof slide surface.

Towards the fulfillment of these objects, and others, the present invention provides a waterslide amusement device formed from a plurality of straight and curved concave flume modules connected together in an end to end relationship to define an inclined waterslide course having an entry pool at an upper end and an exit pool at a lower end. Each module has a flange formed at each end which extends outwardly from the side of the module in a plane transverse to the module. Adjacent modules are connected together by securing the flanges together with suitable securing means. A flow of water is provided between the entry and exit pools such that a waterslide user may slide down the course on a conveying means, such as a flexible plastic mat, with the water acting as a lubricant between the slide surface and the conveying means.

DESCRIPTION OF THE FIGURES

The above description, as well as the objects, features, and advantages, of the present invention will be more fully appreciated by reference to the following detailed description of a presently preferred but nonetheless illustrative embodiment in accordance with the present invention, when taken in conjunction with the accompanying drawings wherein.

DESCRIPTION OF THE PREFERRED EMBODIMENT

Figure 1:
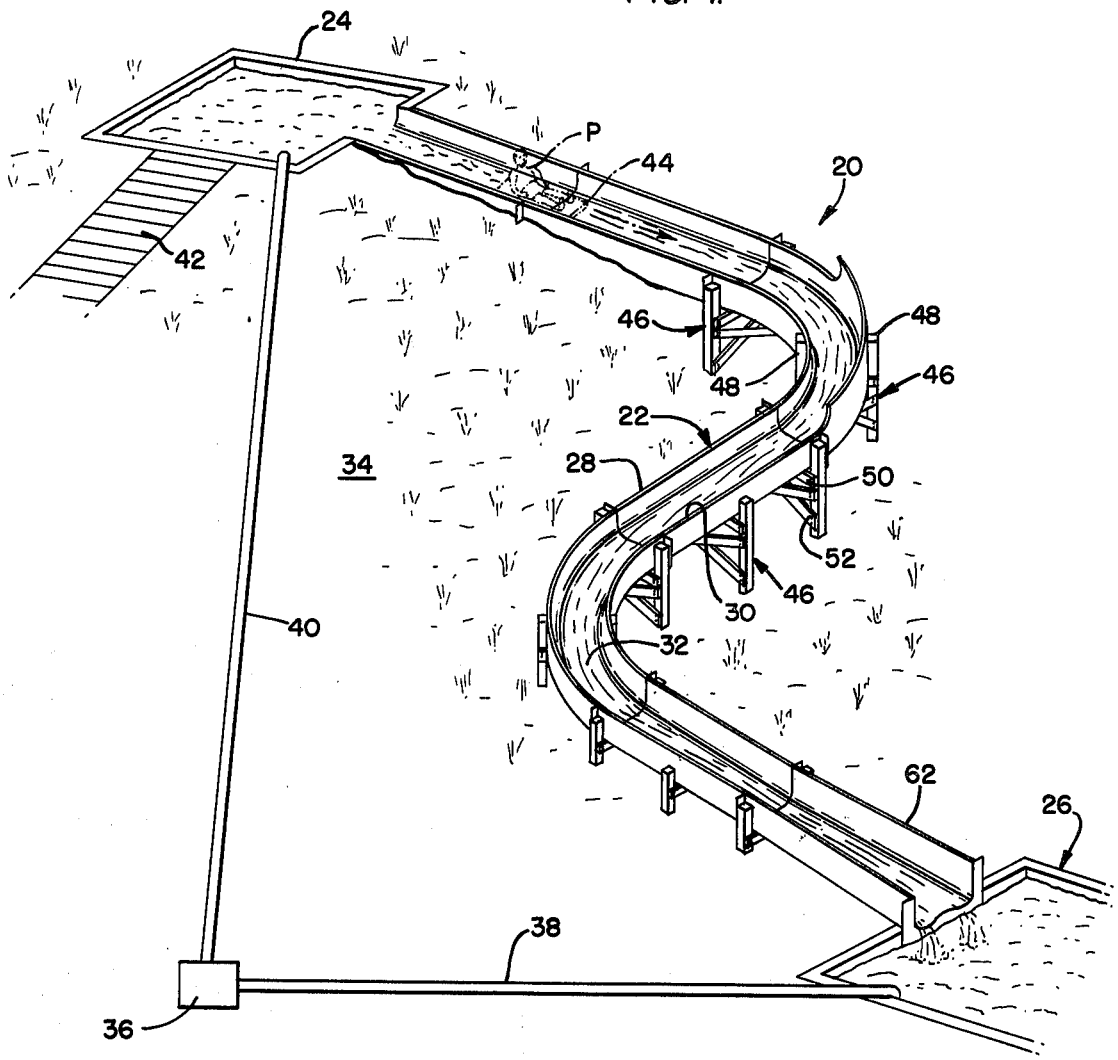
FIG. 1 is a perspective view of a waterslide amusement device of the present invention showing a slide course having an entry pool at an upper end and an exit pool at the lower end.

Referring to FIG. 1 the reference character 20 refers in general to a waterslide amusement device of the present invention which includes a slide course 22 having an entry pool 24 located at one end of the course 22 and an exit pool 26 at the other end of the pool. The slide course 22 includes two spaced apart walls 28 and 30, and a bottom wall 32 which define an inwardly curved, concave flume or channel. The waterslide 20 is preferably installed on a hill 34 with the entry pool 24 at a higher elevation than the exit pool 26 and with the slide course 22 following a sinuous, generally inclined path. Both the entry pool 24 and exit pool 26 are filled with water with the water in the entry pool 24 overflowing into the course 22 to provide a flow of water along the course 22 between the entry pool 24 and the exit pool 26. In the preferred embodiment of FIG. 1, a pump 36, connected to the exit pool 26 by an inlet pipe 38 and to the entry pool 24 by an outlet pipe 40, is provided to pump water from the exit pool 26 to the entry pool 24.

A person P may use the waterslide 20 by entering the entry pool 24 via steps 42 and then sitting or reclining on a conveying mat 44, such as a flexible plastic mat, at the entrance portion of the course 22. The coefficient of friction between the mat 44 and the course 22 is such that the person P rapidly slides down the course 22 to the exit pool 26 with the water acting as a lubricant between the mat 44 and the course 22.

Figure 2:
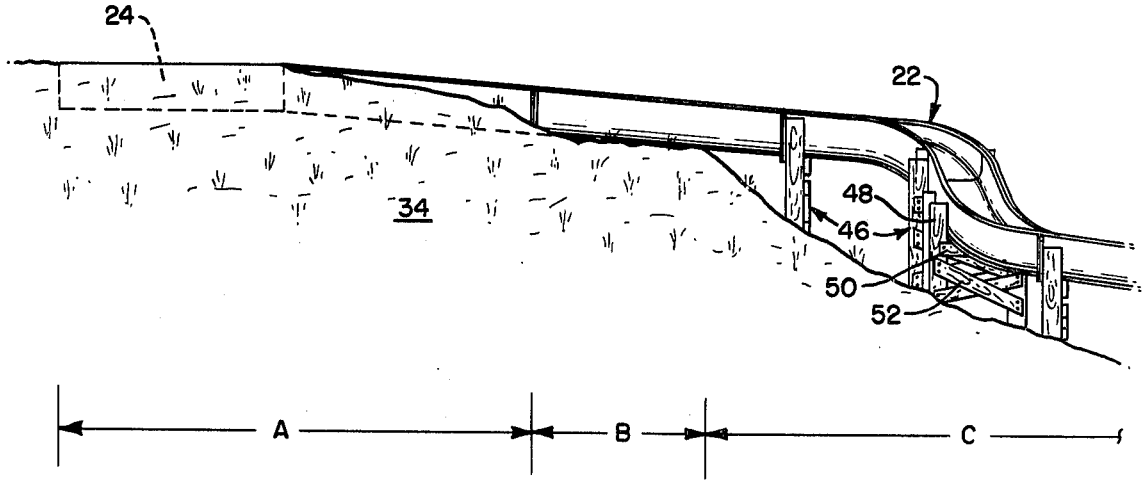
FIG. 2 is a side elevation view of the upper portion of the slide course shown in FIG. 1.

As shown in FIGS. 1 and 2 the entry pool 24 and the exit pool 26, and a first section "A" of the course 22 are embedded in the ground. A second section "B" of the course 22 is supported on the ground, and a third section "C" of the course 22 is as shown supported above the ground on trestles 46 which are spaced along the course 22 path. Each trestle 46 includes a vertical post 48 on each side of the course 22, a transverse beam 50 extending between the posts 48, and cross members 52. As can be readily appreciated, the entire waterslide 20 may be embedded in the ground, supported on the ground, or supported or suspended above the ground by suitable supporting trestles or suspension means. In addition, the course 22 need not follow the sinuous path illustrated in FIG. 1 but may follow any combination of straight, curved, inclining, declining, looping, or winding paths, including paths which are similar to the paths followed by conventional rollercoasters.

Figure 3:
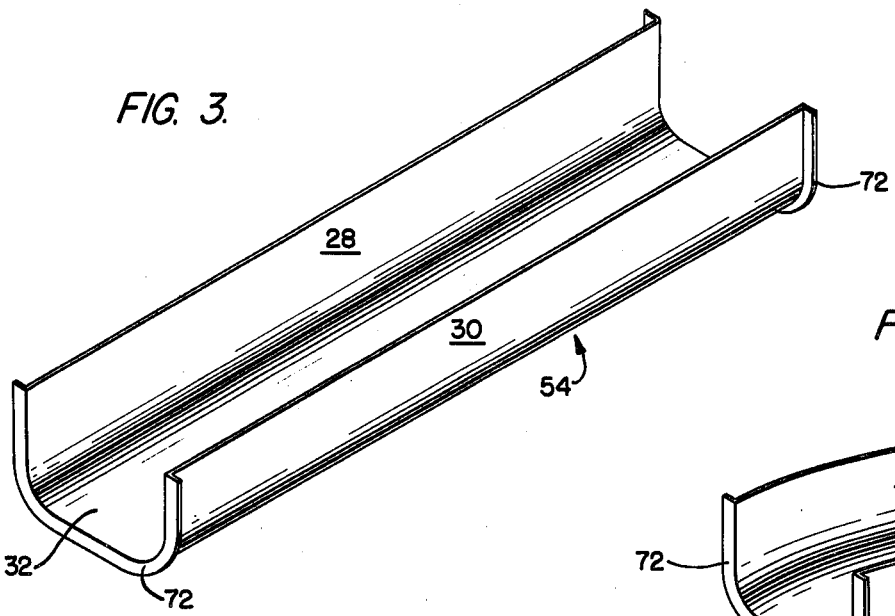
FIG. 3 is a perspective view of a straight flume module formed along a straight line axis.
Figure 4:
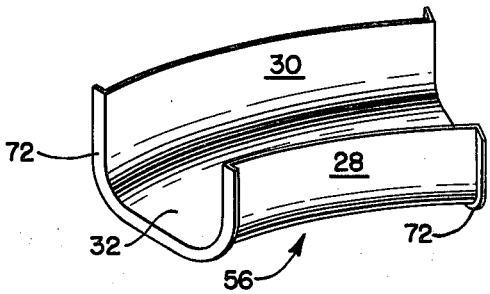
FIG. 4 is a perspective view of a curved flume module formed along an arcuate axis and subtending a first angle.
Figure 5:
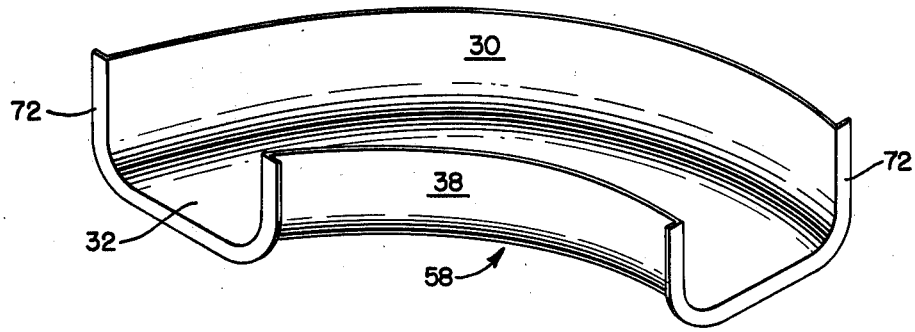
FIG. 5 is a perspective view of another curved flume module formed along an arcuate axis and subtending a second angle.
Figure 6:
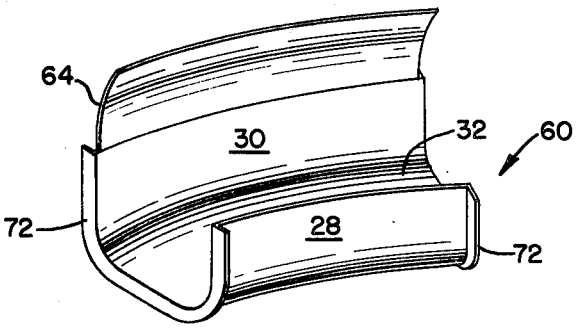
FIG. 6 is a perspective view of a curved flume module having a raised shield formed on the outside wall of the module.
Figure 7:
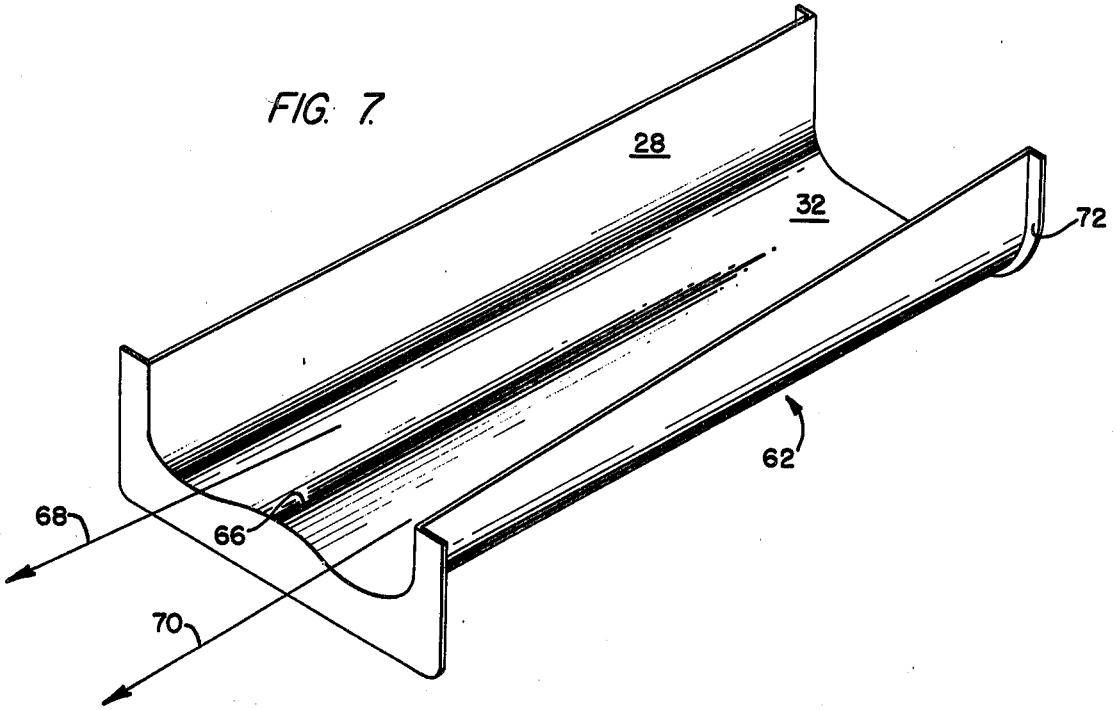
FIG. 7 is a perspective view of a splash-down module having first and second concave paths.

The slide course 22 is fabricated from a plurality of flume modules connected together in an end to end relation. Exemplary modules, shown in FIGS. 3–7, include a straight module 54 (FIG. 3), curved modules 56, 58, and 60 (FIGS. 4, 5, and 6) and a splash down module 62 (FIG. 7). The straight module 54 is formed along a straight line axis and includes the aforementioned side walls 28 and 30, and the bottom wall 32. The curved modules 56, 58 and 60 also include the side walls 28 and 30, and the bottom wall 32, and are formed along an arcuate or curved axis. The curved modules 56, 58 and 60 subtend different angles with the modules 56 and 60 subtending a 45° angle, and the module 58 subtending an 80° angle. The various curved modules, as for example module 60, may be provided with a raised shield 64 (FIG. 6) formed on the outside or exterior side wall 30 of the module 60. The shield 64 serves as a safety guard to confine a person P to the course 22 and thereby prevent the person from being tossed outwardly by centrifugal force. The splash-down module 62 shown in FIG. 7 is the last module of the course 22 and serves as a transition between the modules of FIGS. 3–6 and the exit pool 26. The splash-down module 62 has a centrally raised portion 66 on its bottom wall 32 which defines adjacent but diverging concave paths 68 and 70. The splash-down module 62 allows a person P riding down the course 22 to elect either of the paths 68 or 70 to splash-down into one side of the exit pool 26 or the other and thereby avoid collision with a person (not shown) already in the exit pool.

Figure 8:
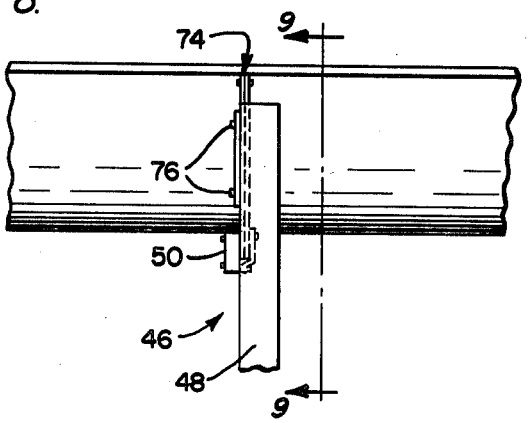
FIG. 8 is a side elevation view of two flume modules connected together in an end to end relationship.

As shown in FIGS. 3–7, each module has a flange 72 formed at each end. The flanges 72 extends outwardly from the side walls 28 and 30 and the bottom wall 32 of the module in a plane transverse to the module. Each flange 72 has identical dimensions and constitutes a complimentary half of a flange joint 74 (FIG. 8). The various modules are connected together in an end to end relationship by securing the flanges 72 of adjacent modules together in abutting relation with suitable securing means, such as threaded fasteners 76 extending through holes in both the flanges 72. In order to assure a water tight flange joint 74, a sealing means (not shown) may be provided between the confronting surfaces of the flanges 72. The sealing means may be in the form of a discrete gasket, or, preferably, in the form of a viscous mastic, such as silicone rubber.

Figure 9:
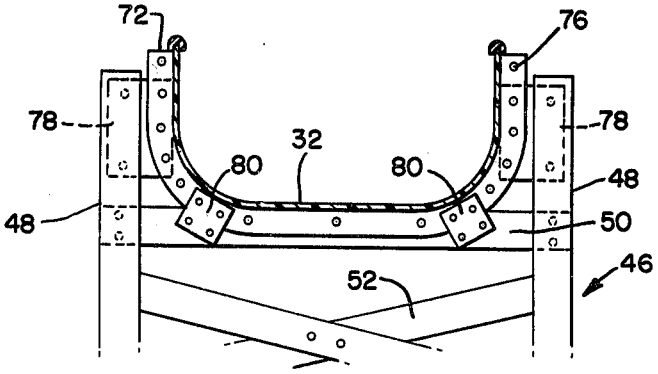
FIG. 9 is a cross section elevation view taken along line 9—9 of FIG. 8 showing the flume module supported on a trestle structure.

The slide course 22 is connected to the trestles 46, described above, as shown in FIGS. 8 and 9. Structural plates 78, which may be steel plates approximately 6–13 mm thick, have a portion thereof secured to the posts 48, and another portion thereof secured to the flanges 72. Other plates 80 similarily attached may also be provided between the transverse beam 50 and the lower portion of the flanges 72.

While a wide variety of material may be utilized to form the modules, a fiberglass reinforced resin is preferred. Fiberglass is strong, with a limited amount of resiliency, and is inherently waterproof and smooth surfaced.

As will be apparent to those skilled in the art, various changes and modifications may be made to the apparatus of the present invention without departing from the spirit and scope of the present invention as recited in the appended claims and their legal equivalent.

What is claimed is:

1. An amusement slide device comprising:

a plurality of concave flume modules, each having complimentary flanges at each end thereof and extending outwardly from the walls of said modules in a plane transverse to said modules;

each module and its flanges being formed as a unitary structure from a fiberglass reinforced resin;

means for securing the flanges of adjacent modules together to connect said modules in an end-to-end relationship to define a waterslide course;

a splash-down module connected to a flume module disposed at one end of said course, said splash-down module defining first and second concave paths which diverge outwardly from said flume module;

an exit pool at said one end of said course and communicating with said splash-down module;

an entry pool communicating with a flume module disposed at the other end of said course; and means for establishing a flow of water from said entry pool, along said course and said splash-down module and to said exit pool.

2. The device claimed in claim 1, further comprising a plurality of plates adapted for connection to said flanges by said connecting means, said plates adapted to connect said course to a support system for supporting at least a portion of said course at an elevated position relative to the ground.

3. The device claimed in claim 2, wherein said support system comprises:

a plurality of trestles extending upwardly from the ground surface for supporting a portion of said course.

4. The device claimed in claim 1, wherein said entry pool is at a higher elevation than said exit pool to permit the water to flow along said course by gravity.

5. The device claimed in claim 1, wherein:

at least one of said modules is formed along a straight line axis; and at least another one of said modules is formed along an arcuate line axis.

6. The device claimed in claim 5, further comprising:

a shield formed on an outer wall portion of said arcuate module and extending upwardly above said arcuate module.

7. The device claimed in claim 1, wherein said means for establishing a flow of water comprises:

a pump having an inlet pipe coupled to said exit pool and an outlet pipe coupled to said entry pool for pumping water from said exit pool to said entry pool.

8. An amusement slide device comprising:

a plurality of concave flume modules;

a flange formed at each end of each module and extending outwardly from the walls of said module in a plane transverse to said modules;

each module and its flanges being formed as a unitary structure from a fiberglass reinforced resin;

a plurality of spaced openings formed through each of said flanges, said openings being complimentary so that they align when adjacent modules are disposed in an end-to-end relationship to form a slide course;

a plurality of support plates associated with each module and having a plurality of openings therein which are adapted to align with a portion of the aligned openings of said flanges;

means for extending through said aligned openings for securing the flanges of adjacent modules together and to said support plates;

a support system adapted to be connected to said support plates for supporting at least a portion of said course at an elevated position relative to the ground;

an entry pool at one end of said course;

an exit pool at the other end of said course;

means for establishing a flow of water along said course from said entry pool to said exit pool; and a splash-down module connected between said course and said exit pool and having first and second concave paths which diverge from one another toward said exit pool.

9. The device claimed in claim 8, wherein said entry pool is at a higher elevation than said exit pool to permit the water to flow along said course by gravity.

10. The device claimed in claim 8, wherein:

at least one of said modules is formed along a straight line axis; and at least another one of said modules is formed along an arcuate line axis.

11. The device claimed in claim 10, further comprising:

a shield formed on an outer wall portion of said arcuate module and extending upwardly above said arcuate module.

12. The device claimed in claim 8, wherein said support system comprises:

a plurality of trestles extending upwardly from the ground surface for supporting a portion of said course.

13. The device claimed in claim 12, wherein a plurality of openings are formed through said treatles for alignment with a portion of said openings in said support plates and further comprising:

means for extending through the aligned openings in said treatles and said support plates for securing said support plates to said trestles.

14. The device claimed in claim 8, wherein said means for establishing a flow of water comprises:

a pump having an inlet pipe coupled to said exit pool and an outlet pipe coupled to said entry pool for pumping water from said exit pool to said entry pool.

15. An amusement slide device comprising:

a plurality of concave flume modules;

a flange formed at each end of each module and extending outwardly from the walls of said module in a plane transverse to said modules;

each module and its flanges being formed as a unitary structure from a fiberglass reinforced resin;

a plurality of spaced openings formed through each of said flanges, said openings being complimentary so that they align when adjacent modules are disposed in an end-to-end relationship to form a slide course;

a plurality of support plates associated with each pair of adjacent modules and having a plurality of openings therein which are adapted to align with a portion of the aligned openings of the respective flanges of said adjacent modules;

means for extending through said aligned openings for securing the flanges of adjacent modules together and to said support plates;

an exit pool at one end of said course;

an entry pool at the other end of said course;

a plurality of trestles extending upwardly from the ground surface for supporting at least a portion of said course at an elevated position relative to the ground;

means for supporting said entry pool at a higher elevation than said exit pool to permit water to flow along said course by gravity;

a plurality of openings formed through each trestle for alignment with a portion of said openings in said support plates; and means for extending through the aligned openings in said trestles and said support plates for securing said support plates to said trestles.

16. The device claimed in claim 15, wherein:

at least one of said modules is formed along a straight line axis; and at least another one of said modules is formed along an arcuate line axis.

17. The device claimed in claim 16, further comprising:

a shield formed on an outer wall portion of said arcuate module and extending upwardly above said arcuate module.

18. The device claimed in claim 15, further comprising:

a pump having an inlet pipe coupled to said exit pool and an outlet pipe coupled to said entry pool for pumping water from said exit pool to said entry pool.

* * * * *